US007003832B2

(12) United States Patent
Wilson

(10) Patent No.: US 7,003,832 B2
(45) Date of Patent: Feb. 28, 2006

(54) CHANGING PAD COVER

(76) Inventor: Mary Bess Wilson, 140 Horseshoe Cir., Destin, FL (US) 32550

( * ) Notice: Subject to any disclaimer, the term of this patent is extended or adjusted under 35 U.S.C. 154(b) by 44 days.

(21) Appl. No.: 10/881,772

(22) Filed: Jun. 30, 2004

(65) Prior Publication Data

US 2006/0000023 A1 Jan. 5, 2006

(51) Int. Cl.

| | |
|---|---|
| ***A47G 9/00*** | (2006.01) |
| ***A47G 9/64*** | (2006.01) |
| ***A47D 5/00*** | (2006.01) |
| ***A47D 15/00*** | (2006.01) |

(52) U.S. Cl. ..... 5/655; 5/421; 5/482; 5/915; 5/484; 5/497; 5/738; 219/217; 601/49

(58) Field of Classification Search ..... 5/655, 5/421, 915, 482, 490, 420, 484, 497, 738; 219/217; 601/49, 56, 57, 98

See application file for complete search history.

(56) References Cited

U.S. PATENT DOCUMENTS

| | | | | |
|---|---|---|---|---|
| 2,659,421 | A * | 11/1953 | Wass et al. | 5/657.5 |
| 4,202,052 | A | 5/1980 | Bilanzich | |
| 4,388,738 | A * | 6/1983 | Wagner | 5/421 |
| 4,442,558 | A | 4/1984 | Alexander | |
| 4,899,408 | A | 2/1990 | Illingworth | |
| 4,922,565 | A | 5/1990 | Blake | |
| 5,086,530 | A | 2/1992 | Blake | |
| 5,787,527 | A | 8/1998 | Anderson | |
| 6,067,677 | A | 5/2000 | Reen et al. | |
| 6,243,895 | B1 | 6/2001 | Amin | |
| 6,256,818 | B1 * | 7/2001 | Hughes | 5/639 |
| 6,301,729 | B1 | 10/2001 | Hall | |
| 6,381,778 | B1 | 5/2002 | Peterson | |
| 6,389,624 | B1 * | 5/2002 | Madole | 5/655 |
| 6,505,367 | B1 * | 1/2003 | Griffin et al. | 5/655 |
| 6,631,528 | B1 | 10/2003 | Landry | |
| 6,634,042 | B1 | 10/2003 | Blossman | |
| 6,681,422 | B1 | 1/2004 | Landry | |
| 6,957,454 | B1 * | 10/2005 | Newton | 5/421 |
| 2003/0066133 | A1 | 4/2003 | Blossman | |
| 2003/0126685 | A1 * | 7/2003 | Fryer | 5/655 |
| 2003/0154549 | A1 | 8/2003 | Landry | |
| 2003/0177579 | A1 | 9/2003 | Diak et al. | |

FOREIGN PATENT DOCUMENTS

| | | |
|---|---|---|
| FR | 2 734 136 A1 | 11/1996 |

* cited by examiner

*Primary Examiner*—Alexander Grosz
(74) *Attorney, Agent, or Firm*—Dennis G. Lapointe

(57) ABSTRACT

A changing pad cover having two generally parallel vinylized/fabric layers spaced-apart and four upright sides connecting each spaced-apart layer. One or both ends of the cover may have its raised sides contoured-shaped on its upper edge to allow for the upper layer of the cover to conform to the contoured upper surface shape of the pad. The cover is secured at one end with a closure device such as a hook and loop fastener. The vinylized layer comprises a clear liquid impermeable layer, which is superimposed in a face-to-face relationship with an underlying fabric material. The fabric material has decorative visual art indicia depicted on the fabric material. The cover may optionally include a heating pad and/or a vibrating pad in an underlying relationship to the fabric material of the upper portion of the cover or integral to the fabric material. An alternative embodiment includes the top and sides of the cover only.

44 Claims, 4 Drawing Sheets

10
22
22a 10
22
22b 10
22
22b
12

CHANGING PAD COVER

FIELD OF THE INVENTION

The invention relates to sanitary and decorative changing pad covers for use when changing children's diapers.

BACKGROUND OF THE INVENTION

The current apparatus used to change diapers typically consists of a foam core covered with a thin white plastic film that is unattractive and can crack over time. FIGS. 4*a*–4*c* show representative shapes of such pads. It is designed to work in conjunction with a changing pad cover (in most cases, terry-cloth), which provides the baby with a soft surface. The colors are usually selected in colors of the nursery, which is a major contemplated user of the present invention.

The pad must be removed immediately upon being soiled to prevent stains and/or contamination by urine or feces and unpleasant odors. This creates a large laundry workload for the new family, who must typically purchase at least three covers to rotate onto the pad.

The present invention discussed below eliminates the need for such laundry workload by providing a smooth or essentially flat non-dimpled laminated top surface that is easily cleaned for subsequent uses. Most pads have dimpled top surfaces usually from decorative stitching and/or stitching along crease lines for contoured pads. These stitch lines often crack thereby shortening the life of the pad unless it is repairable. The top surface of the present invention lacks such dimpled surfaces, therefore is easily cleaned and sanitized.

Further, the present invention eliminates the need for an additional cover. When used in nurseries, the laminated fabric changing pad cover of the present invention can remain in the nursery and the pictorial or visual art depictions coordinate with the colors or theme of the nursery environment and decor at all times, thereby giving the nursery owner a more attractive alternative to the white pad covered with cloth or a towel.

Because the present invention eliminates the need for laundering, cost savings can be realized in both time and money. Purchase price of multiple additional covers is eliminated as well as expenses associated with laundering cloth covers, such as soap, electricity and water. Further, savings include the time itself saved from having to launder soiled covers, a premium for any new mother.

SUMMARY OF THE INVENTION

In one embodiment, the present invention is generally a changing pad cover for baby diaper changing pads having two generally parallel vinylized/fabric layers spaced-apart and four upright sides connecting each spaced-apart layer. The cover is generally rectangularly shaped. One or both ends of the cover may have its raised sides contoured-shaped on its upper edge to allow for the upper layer of the cover to conform to the contoured upper surface shape of the pad. The cover slips over the pad like a pillow cover and is secured at one end with closure means, such as a zipper or hook and loop fastener connection (similar to VELCRO® fasteners), which in turn can be covered so the baby cannot rub an arm or leg against the zipper or hook and loop fastener surface.

Each vinylized layer preferably comprises a clear vinyl (polymeric) layer, that is, a substantially waterproof or impermeable layer, which is superimposed or in a face-to-face relationship with an underlying material, preferably made from a fabric. Alternatively, the upper portion only of the cover may have the impermeable layer or the combination of the upper portion and the side portions may have the impermeable layer. The underlying material has decorative visual art indicia depicted on it so as to be visually observable through the vinyl layer. The underlying material when made from a fabric material may be made from cotton, polyester, rayon or combinations of these materials. The underlying material may also be made from a polymeric material. The top portion of the cover may also include an opening in which a safety belt-like strap protrudes from the pad itself to prevent the baby from rolling off the changing table/pad. Alternatively, the top portion of the cover itself may include a safety belt-like strap to prevent the baby from rolling off the changing table/pad.

The cover may optionally include heating pad means and/or vibrating means in an underlying relationship to the fabric material of the upper portion of the cover or the heating and vibrating devices may instead be incorporated integral to the fabric material in the manner that electric blankets are made.

In an alternative embodiment, the cover is sized and adapted to generally enclose a changing pad top surface and its sides. In this embodiment, the above-described cover and its different features could be made such that it would comprise an upper portion as above and the side portions as described above; however, the side portions would be either attached to the pad near the bottom portion of the pad or sufficiently extend under the pad so as to attach on the bottom portion of the pad itself. Attachment means known in the art could be used such as hook and loop fasteners, clips and buttons, and other similar attachments. In addition, opposite side portions could be secured one to the other by the use of one or more elastic bands or hook and look fastener straps extending from one side of the side portions, across the underside of the pad, to the opposite side of the side portions. Another method of securing the cover to the pad is to have an elastic along the perimeter of the bottom edges of the side portions similar to what is used with fitted sheets. There are other numerous methods to secure the cover to the pad known in the art, accordingly they need not be repeated herein. A visit to any bedding specialty store will provide many known ideas on how to attach the cover to the pad in this alternative embodiment.

DETAILED DESCRIPTION OF THE INVENTION

Figure 1:
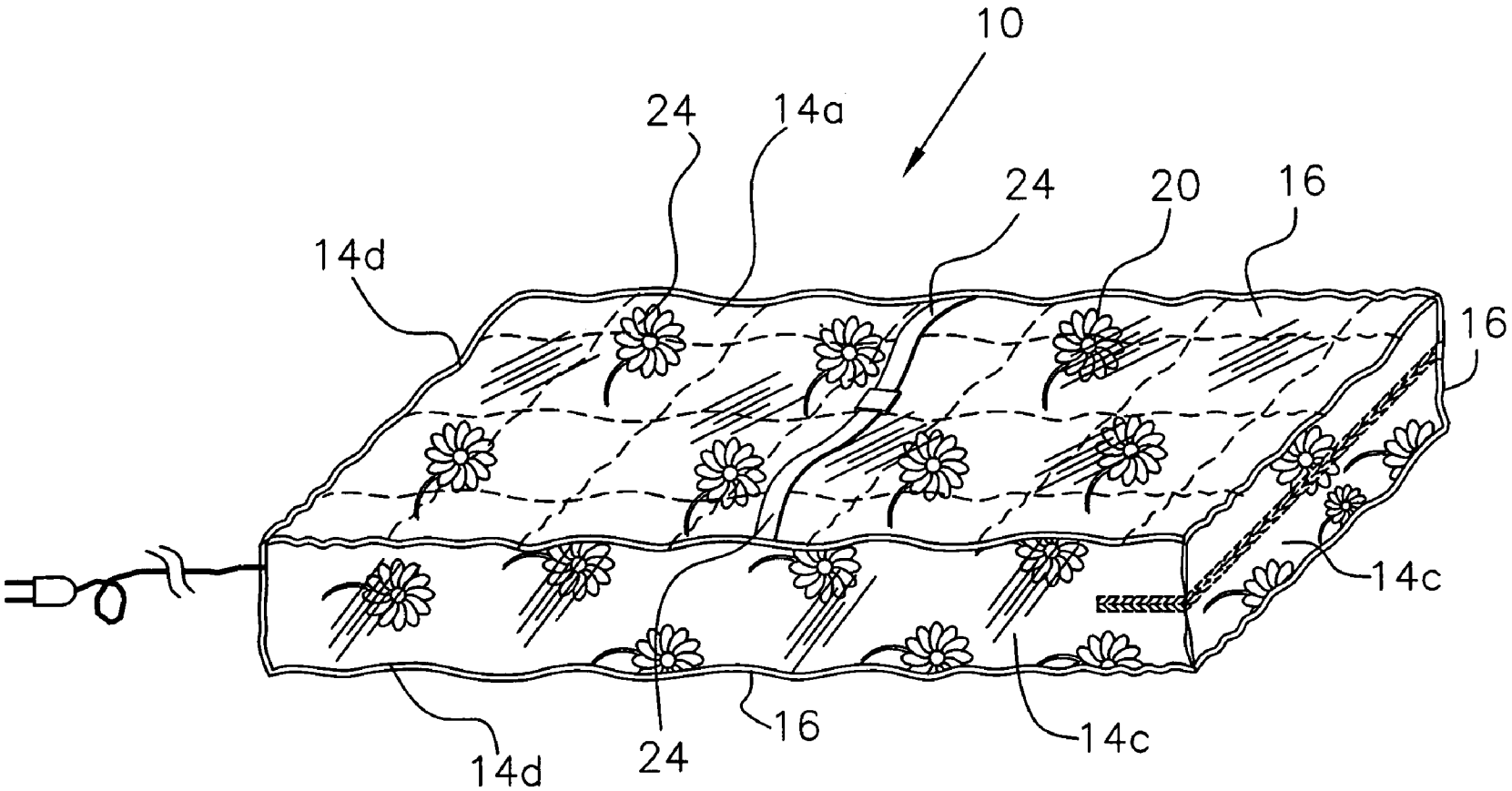
FIG. 1 is a perspective conceptual view of the present invention in one embodiment where the pad used, but not shown, is typical of FIG. 4*a* below.
Figure 2A:
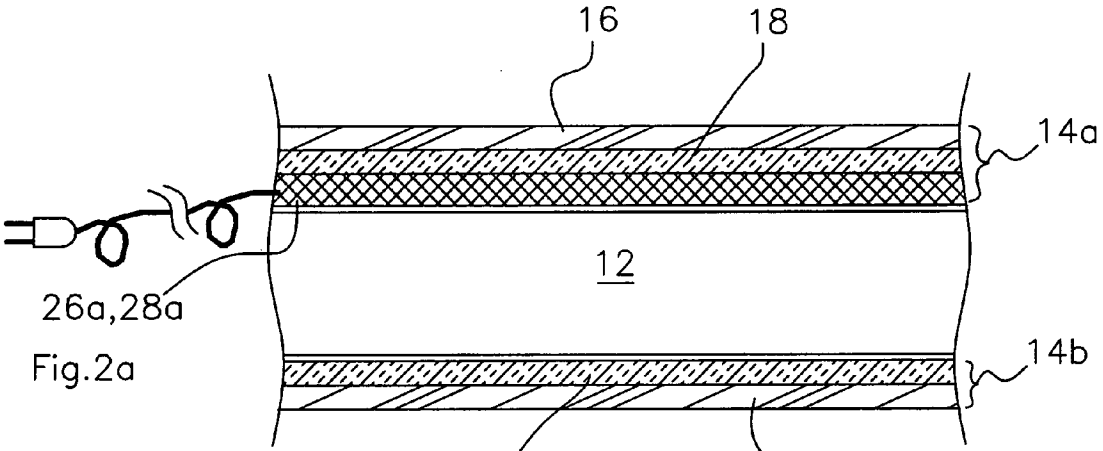
FIG. 2*a* is a cross-sectional conceptual view of the various contemplated layers comprising the present inventive cover, the pad being generic to any shape.
Figure 2B:
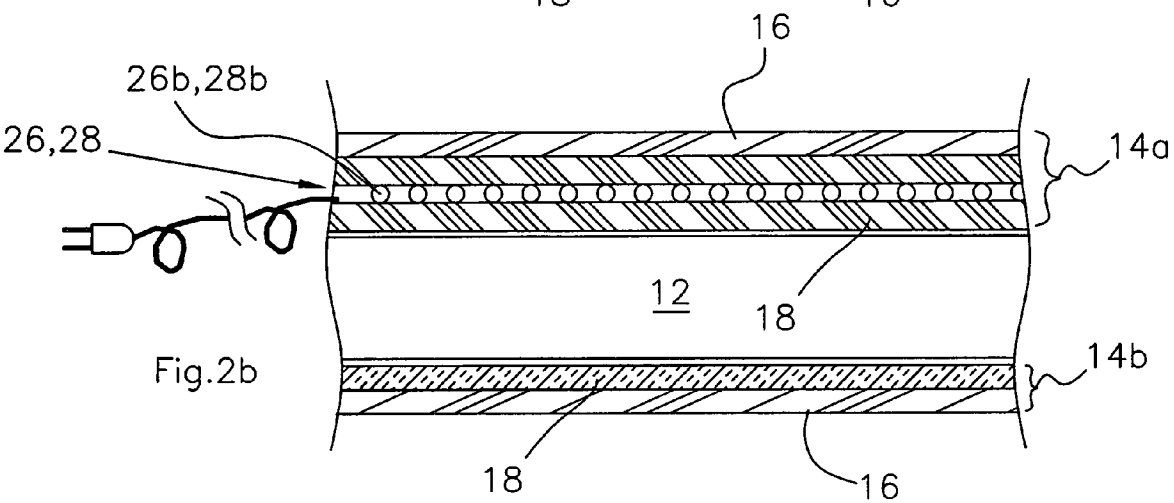
FIG. 2*b* is a cross-sectional conceptual view of an alternative embodiment of the contemplated layers depicted in FIG. 2*a*, except that the heating and/or vibrating feature of the invention is integrally incorporated in the underlying layer.
Figures 3A, 3B, 3C:
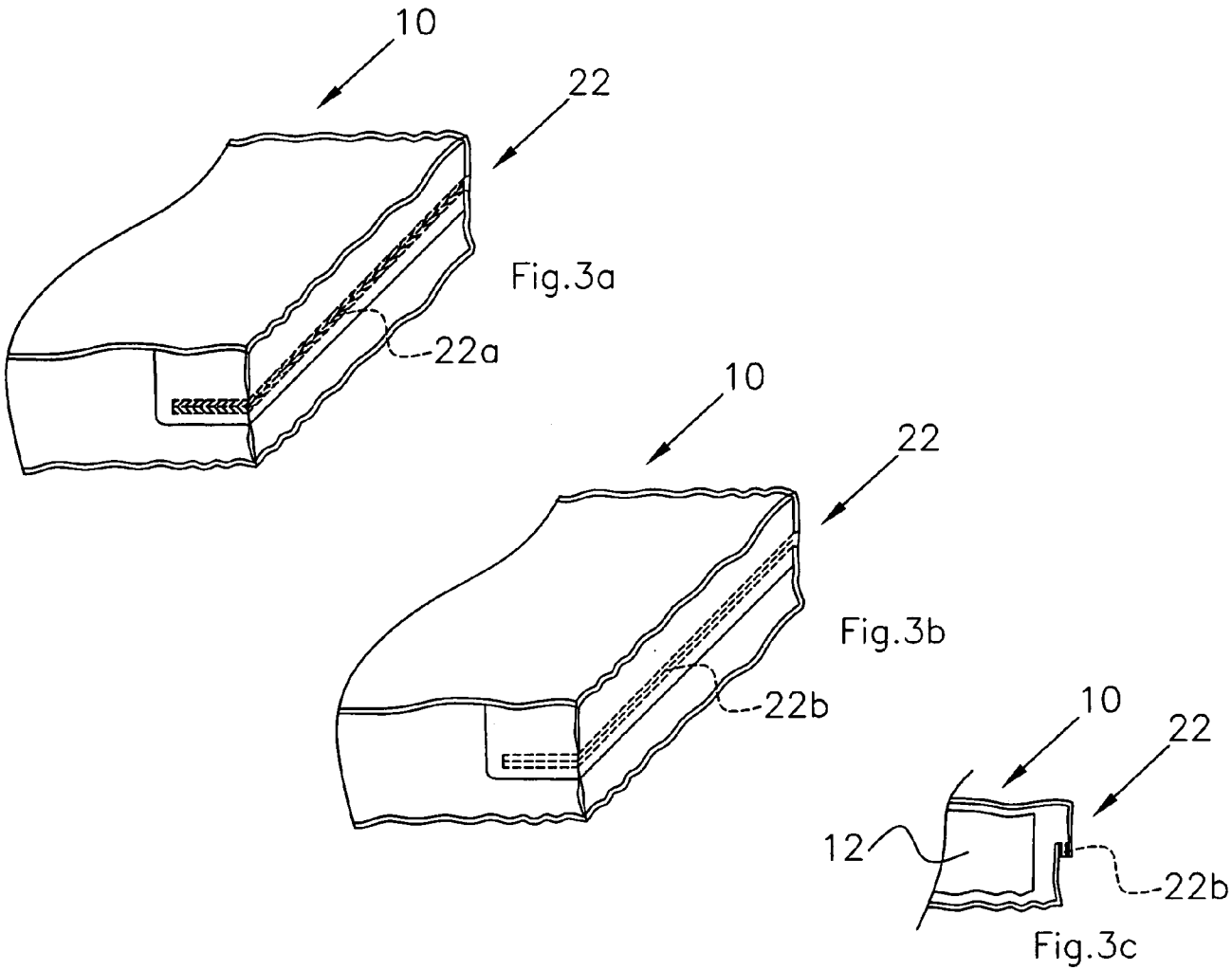
FIG. 3*a* is an example of typical closure means for the cover, depicting the use of a hidden zipper.
FIG. 3*b* is an example of typical closure means for the cover, depicting the use of a hidden hook and loop fastener.
FIG. 3*c* is a sectional view from FIG. 3*b* depicting the use of a hidden hook and loop fastener.
Figure 4A:
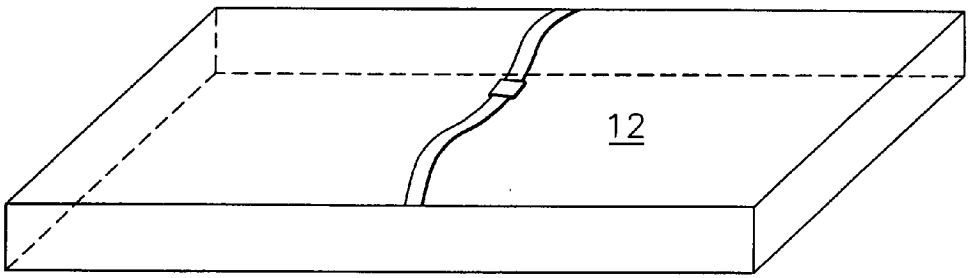
FIG. 4*a* is a perspective view of a generic typical changing pad showing a rectangularly shaped pad with flat upper and bottom surfaces.
Figure 4B:
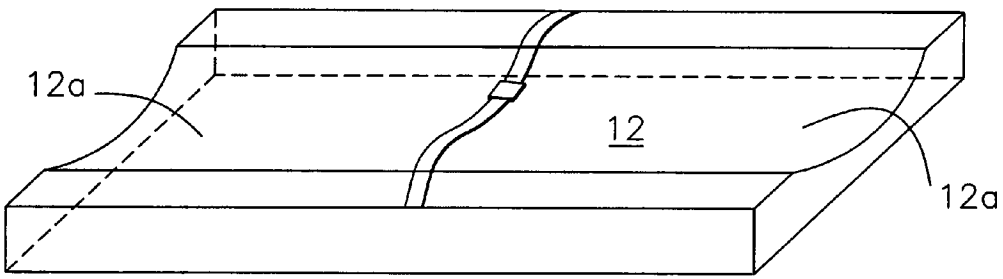
FIG. 4*b* is a perspective view of a generic typical changing pad showing a generally rectangularly shaped pad with a flat bottom surface and an upper contoured surface extending from one edge of the pad to the opposite end of the pad.
Figure 4C:
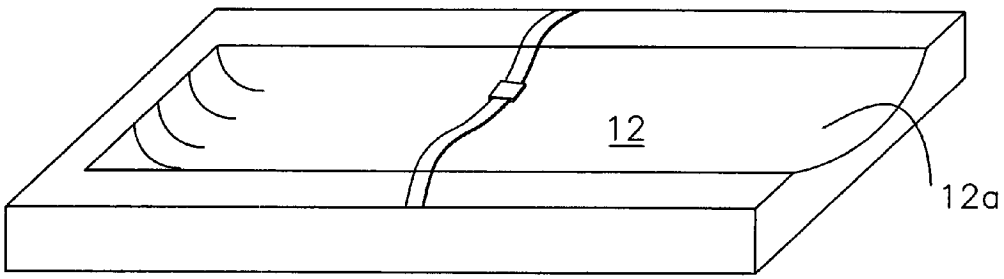
FIG. 4*c* is a perspective view of a generic typical changing pad showing a generally rectangularly shaped pad with a flat bottom surface and an upper partially contoured surface extending from one edge of the pad to substantially its opposite end, at which end the contour features taper back to the same configuration of the of the side edges of the pad.

Referring now to the drawings, FIG. 1 discloses a conceptual ready for use embodiment of the present invention, which is a changing pad cover, depicted generally as 10. Typical pads 12 and their respective shapes contemplated to be covered by the present invention 10 are depicted in FIGS. 4*a*–4*c*.

As further conceptually depicted in FIGS. 2*a*–2*b* and 3*a*–3*c*, the invention is a changing pad cover 10, which includes a generally rectangular-shaped upper portion 14*a* and a spaced-apart lower portion 14*b* with upright side portions 14*c*. The upper portion and the lower portions 14*a*,14*b* are connected to the respective upright side portions 14*c* along respective perimeter edges 14*d* thereof. The connection means can be done in a number of ways known in the art, including stitching, adhesive joints, or combinations of adhesive and stitching as appropriate. It is preferable that some form of blind stitching be utilized to minimize any soil or contaminant trap areas along the perimeter edges 14*d* of the cover 10.

The upper, lower and upright side portions 14*a*,14*b*,14*c* further comprise a see-through liquid impermeable top layer 16, which is superimposed in a face-to-face relationship with an underlying layer 18.

The underlying layer 18 has decorative visual art indicia 20 depicted on the underlying layer 18 so as to be visually observable through the see-through liquid impermeable top layer 16. This indicia 20 is typically located on at least the underlying layer 18 part that underlies the impermeable top layer 16 of the upper portion 14*a* of the cover 10. Indicia 20 can be any desired art work, such as animals, plants, trees, gardens, simple colored stripes, sport themes with players and appropriate backgrounds, environmental themes such as waterfalls, solid colors, multiple colors and almost any combination of art work imaginable. This is intended to allow the cover 10 to blend in with color schemes of the environment where it is to be used or with a specific room color scheme or other desired theme. The floral depiction shown in FIG. 1 is only intended to be an example of indicia and of course, colors are not shown as it is understood that the indicia 20 could come in the color(s) typically associated with the chosen indicia 20.

The cover 10 is sized to fully enclose a changing pad 12. The sizing is such that the pad 12 can be easily inserted in the cover 10, not much different than how one might slide a pillow into a zippered pillow cover.

In order to properly secure the pad 12 inside the cover 10 after insertion of the pad 12, closure means 22 are provided at one end of the cover 10. This can be done in a number of ways known in the art, including the use of a zipper system 22*a* such as that exemplified in FIG. 2*a*, or a hook and loop fastener system 22*b* such as that exemplified in FIGS. 2*c* and 3*c*. The closure means 22 can extend just on the end portion but it is preferable that it turn the corners of the cover 10 to facilitate the easier insertion of the pad 12 inside the cover 10. In addition, it is also preferred that a portion of one side of the upright side portion 14*c* in the area where the closure means 22 is located be designed to overlap the closure means 22 so as to serve as means for protecting a child's limbs from coming in contact with the closure means 22.

Although the underlying layer 18 can be made from assorted materials including polymeric materials (such as a vinyl material), it is preferred that it be made from a fabric material. The fabric material may be made from cotton, polyester, rayon or combinations of these materials. Obviously the print indicia 20 on the fabric can be selected to project whatever color scheme or theme one desires as a coordinate to various rooms in which the cover 10 will be used.

The see-through liquid impermeable layer 16 is preferably made from a polymeric material, such as a poly-vinyl material. It is see-through in the sense that it is clear or at least sufficiently transparent to be able to see the pictorial indicia 20 on the underlying layer 18.

As observable from the various examples of pad shapes depicted in FIGS. 4*a*–4*c*, in order to allow for a better fit of the cover 10 over the pad 12, one end of the cover 10 may have its raised upright side portion 14*c* at least partially contoured-shaped on its upper edge to allow for the upper portion 14*a* of the cover 10 to conform to a contoured upper surface 12*a* shape of the pad 12. For pad 12 configurations similar to FIG. 4*b*, both ends of the cover 10 may have its raised upright side portions 14*c* at least partially contoured-shaped on its upper edge to allow for the upper portion 14*a* of the cover 10 to conform to a contoured upper surface 12*a* shape of the pad 12.

As a matter of safety for the child, it is recommended that means 24 for securing a child on the upper portion 14*a* of the cover 10 be incorporated at an intermediate location and transverse to the length of the cover 10 as shown in FIG. 1. The safety strap system 24 depicted in FIG. 1 is merely an example of how this feature could be incorporated. Instead of a clip engagement device at the end of the straps, hook and loop fasteners could be used in combination with a clip type of engagement device. Instead of the engagement taking place somewhere near the center, one strap could be long enough to essentially completely cross over the upper portion 14*a* and engage a hook and loop fastener or belt clip near the corner or along the side 14*c* of the cover 10. The attachment point of each strap end is a matter of design choice with the manufacturer. That is, there are several other ways known in the art to provide such safety belts, given the inventive features of the present invention. Those listed herein are only intended to be examples thereof.

In an alternative embodiment (see FIGS. 3*b*–3*c*), it may desirable to provide heat or soothing vibration effects to the cover 10.

For example, the upper portion 14*a* of the cover may optionally include means 26*a* for providing heat through the top layer 16. This can be provided by including another underlying heating pad layer 26*a*, which is effectively in a face-to-face underlying relationship to at least a portion of the underlying layer 18 of the upper portion 14*a*. That is, the heating pad apparatus (see conceptual 26*a* in FIG. 2*a*) could be merely underlying to the underlying layer 18 or could be stitched or otherwise attached to the underlying layer 18 in such a way that the cover, including the attached heating pad device 26*a*, can easily slide over the pad 12. As with any such invention, the heating elements need not extend to provide heat transfer across the total areas of the upper portion 14*a*, but it is only sufficient that the heating means 26 be sized to provide heat to the central area on which the child is expected to be positioned.

Another alternative way to provide a heating feature is to provide heating elements integrally, that is, by integrally incorporating the heating elements or means 26 (see conceptual 26*b* in FIG. 2*b*) in at least a portion of the underlying layer 18 of the upper portion 14*a*. This concept is essentially like taking an electric blanket material as the underlying layer 18.

Another alternative embodiment is to provide means 28 for providing a therapeutic vibrating sensation to a child on the upper portion 14*a* of the cover 10. As with the heating feature discussed above, the means 28 for providing the therapeutic vibrating sensation to the child on the upper portion 14*a* of the cover 10 includes vibration means included in a pad (see conceptual 28*a* in FIG. 2*a*), which in turn, is in a face-to-face underlying relationship to at least a portion of the underlying layer 18 of the upper portion 14*a*. Such vibratory sensors of elements are known in the art and can be incorporated in a pad which is in turn attached to the underlying layer 18 in the same way that the underlying heating pad discussed above would be.

An alternative to this embodiment is where the means 28 for providing the therapeutic vibrating sensation to the child on the upper portion 14*a* of the cover 10 includes vibration means (see conceptual 28*b* in FIG. 2*b*) integrally incorporated in at least a portion of the underlying layer 18 of the upper portion 14*a*. Again this is similar to an electric blanket type of concept, except the elements causing the vibratory sensation is enclosed within the underlying layer 18 material.

Of course, it is also contemplated that both heating and vibratory features can be incorporated in the cover 10, for example, in a separate pad underlying layer 18 or integrally incorporated in the underlying layer 18.

As described above in the summary portion of this description, in an alternative embodiment, the cover 10 is sized and adapted to generally enclose a changing pad 12 top surface and its sides. In this embodiment, the above-described cover 10 and its different features could be made such that it would comprise an upper portion 14*a* as above and the side portions 14*c* as described above; however, the side portions 14*c* would be either attached to the pad 12 near the bottom portion of the pad 12 or sufficiently extend under the pad 12 so as to attach on the bottom portion of the pad itself. Attachment means known in the art could be used such as hook and loop fasteners, clips and buttons, and other similar attachments. In addition, opposite side portions 14*c* could be secured one to the other by the use of one or more elastic bands or hook and look fastener straps extending from one side of the side portions 14*c*, across the underside of the pad 12, to the opposite side of the side portions 14*c*. Another method of securing the cover 10 to the pad 12 is to have an elastic along the perimeter of the bottom edges 14*d* of the side portions 14*c* similar to what is used with fitted sheets. There are other numerous methods to secure the cover to the pad known in the art, accordingly they need not be repeated herein. A visit to any bedding specialty store will provide many known ideas on how to attach the cover to the pad in this alternative embodiment.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

What is claimed is:

1. A changing pad cover comprising:

a generally rectangular-shaped upper portion and a spaced-apart lower portion with upright side portions connecting the upper portion and the lower portion;

the upper portion further comprising a see-through substantially liquid impermeable top layer, which is superimposed in a face-to-face relationship with an underlying layer;

the underlying layer having decorative visual art indicia depicted on the underlying layer so as to be visually observable through the see-through liquid impermeable top layer, said indicia being located on at least the underlying layer underlying the impermeable top layer of the upper portion of the cover;

the cover being sized to fully enclose a changing pad;

means for securing a child on the upper portion of the cover;

means for providing heat through the impermeable top layer, comprising heating means integrally incorporated in at least a portion of the underlying layer of the upper portion; and closure means at one end of the cover for securing the pad in the cover after the pad has been inserted therein.

2. The cover according to claim 1, wherein the lower portion further includes the see-through substantially liquid impermeable top layer, which is superimposed in the face-to-face relationship with the underlying layer.

3. The cover according to claim 1, wherein the upright side portions further include the see-through substantially liquid impermeable top layer, which is superimposed in the face-to-face relationship with the underlying layer.

4. The cover according to claim 1, wherein the underlying layer is a fabric material.

5. The cover according to claim 1, wherein the see-through substantially liquid impermeable layer is made from a polymeric material.

6. The cover according to claim 1, wherein one end of the cover may have its raised upright side portion at least partially contoured-shaped on its upper edge to allow for the upper portion of the cover to conform to a contoured upper surface shape of the pad.

7. The cover according to claim 1, wherein both ends of the cover may have its raised upright side portions at least partially contoured-shaped on its upper edge to allow for the upper portion of the cover to conform to a contoured upper surface shape of the pad.

8. The cover according to claim 1, wherein the closure means at one end of the cover for securing the pad in the cover is a zipper.

9. The cover according to claim 1, wherein the closure means at one end of the cover for securing the pad in the cover is a hook and loop fastener.

10. The cover according to claim 1, wherein the closure means is overlapped with a portion of the upright side portions, said overlap serving as means for protecting a child's limbs from coming in contact with the closure means.

11. The cover according to claim 1, further comprising:

means for providing a therapeutic vibrating sensation to a child on the upper portion of the cover.

12. The cover according to claim 11, wherein the means for providing the therapeutic vibrating sensation to the child on the upper portion of the cover includes vibration means included in pad, which is in a face-to-face underlying relationship to at least a portion of the underlying layer of the upper portion.

13. The cover according to claim 11, wherein the means for providing the therapeutic vibrating sensation to the child on the upper portion of the cover includes vibration means integrally incorporated in at least a portion of the underlying layer of the upper portion.

14. A changing pad cover comprising:

a generally rectangular-shaped upper portion with side portions depending from a perimeter of said upper portion;

the upper and upright side portions further comprising a see-through substantially liquid impermeable top layer, which is superimposed in a face-to-face relationship with an underlying layer;

the underlying layer having decorative visual art indicia depicted on the underlying layer so as to be visually observable through the see-through liquid impermeable top layer, said indicia being located on at least the underlying layer underlying the impermeable top layer of the upper portion of the cover;

means for securing a child on the upper portion of the cover;

means for providing heat through the impermeable top layer comprising heating means integrally incorporated in at least a portion of the underlying layer of the upper portion; and the cover being sized and adapted to generally enclose a changing pad top surface and its sides.

15. The cover according to claim 14, wherein upright side portions further include the see-through substantially liquid impermeable top layer, which is superimposed in the face-to-face relationship with the underlying layer.

16. The cover according to claim 14, wherein the underlying layer is a fabric material.

17. The cover according to claim 14, wherein the see-through substantially liquid impermeable layer is made from a polymeric material.

18. The cover according to claim 14, wherein one end of the cover may have its raised upright side portion at least partially contoured-shaped on its upper edge to allow for the upper portion of the cover to conform to a contoured upper surface shape of the pad.

19. The cover according to claim 14, wherein both ends of the cover may have its raised upright side portions at least partially contoured-shaped on its upper edge to allow for the upper portion of the cover to conform to a contoured upper surface shape of the pad.

20. The cover according to claim 14, further comprising:

means for providing a therapeutic vibrating sensation to a child on the upper portion of the cover.

21. The cover according to claim 20, wherein the means for providing the therapeutic vibrating sensation to the child on the upper portion of the cover includes vibration means included in pad, which is in a face-to-face underlying relationship to at least a portion of the underlying layer of the upper portion.

22. The cover according to claim 20, wherein the means for providing the therapeutic vibrating sensation to the child on the upper portion of the cover includes vibration means integrally incorporated in at least a portion of the underlying layer of the upper portion.

23. A changing pad cover comprising:

a generally rectangular-shaped upper portion and a spaced-apart lower portion with upright side portions connecting the upper portion and the lower portion;

the upper portion further comprising a see-through substantially liquid impermeable top layer, which is superimposed in a face-to-face relationship with an underlying layer;

the underlying layer having decorative visual art indicia depicted on the underlying layer so as to be visually observable through the see-through liquid impermeable top layer, said indicia being located on at least the underlying layer underlying the impermeable top layer of the upper portion of the cover;

the cover being sized to fully enclose a changing pad;

means for securing a child on the upper portion of the cover;

means for providing a therapeutic vibrating sensation to a child on the upper portion of the cover comprising vibration means integrally incorporated in at least a portion of the underlying layer of the upper portion; and closure means at one end of the cover for securing the pad in the cover after the pad has been inserted therein.

24. The cover according to claim 23, wherein the lower portion further includes the see-through substantially liquid impermeable top layer, which is superimposed in the face-to-face relationship with the underlying layer.

25. The cover according to claim 23, wherein the upright side portions further include the see-through substantially liquid impermeable top layer, which is superimposed in the face-to-face relationship with the underlying layer.

26. The cover according to claim 23, wherein the underlying layer is a fabric material.

27. The cover according to claim 23, wherein the see-through substantially liquid impermeable layer is made from a polymeric material.

28. The cover according to claim 23, wherein one end of the cover may have its raised upright side portion at least partially contoured-shaped on its upper edge to allow for the upper portion of the cover to conform to a contoured upper surface shape of the pad.

29. The cover according to claim 23, wherein both ends of the cover may have its raised upright side portions at least partially contoured-shaped on its upper edge to allow for the upper portion of the cover to conform to a contoured upper surface shape of the pad.

30. The cover according to claim 23, wherein the closure means at one end of the cover for securing the pad in the cover is a zipper.

31. The cover according to claim 23, wherein the closure means at one end of the cover for securing the pad in the cover is a hook and loop fastener.

32. The cover according to claim 23, wherein the closure means is overlapped with a portion of the upright side portions, said overlap serving as means for protecting a child's limbs from coming in contact with the closure means.

33. The cover according to claim 23, wherein the upper portion of the cover further comprises:

means for providing heat through the impermeable top layer.

34. The cover according to claim 33, wherein the means for providing heat through the impermeable top layer is a heating pad layer in a face-to-face underlying relationship to at least a portion of the underlying layer of the upper portion.

35. The cover according to claim 33, wherein the means for providing heat through the impermeable top layer comprises heating means integrally incorporated in at least a portion of the underlying layer of the upper portion.

36. A changing pad cover comprising:

a generally rectangular-shaped upper portion with side portions depending from a perimeter of said upper portion;

the upper and upright side portions further comprising a see-through substantially liquid impermeable top layer, which is superimposed in a face-to-face relationship with an underlying layer;

the underlying layer having decorative visual art indicia depicted on the underlying layer so as to be visually observable through the see-through liquid impermeable top layer, said indicia being located on at least the underlying layer underlying the impermeable top layer of the upper portion of the cover;

means for securing a child on the upper portion of the cover;

means for providing a therapeutic vibrating sensation to a child on the upper portion of the cover comprising vibration means integrally incorporated in at least a portion of the underlying layer of the upper portion; and the cover being sized and adapted to generally enclose a changing pad top surface and its sides.

37. The cover according to claim 36, wherein upright side portions further include the see-through substantially liquid impermeable top layer, which is superimposed in the face-to-face relationship with the underlying layer.

38. The cover according to claim 36, wherein the underlying layer is a fabric material.

39. The cover according to claim 36, wherein the see-through substantially liquid impermeable layer is made from a polymeric material.

40. The cover according to claim 36, wherein one end of the cover may have its raised upright side portion at least partially contoured-shaped on its upper edge to allow for the upper portion of the cover to conform to a contoured upper surface shape of the pad.

41. The cover according to claim 36, wherein both ends of the cover may have its raised upright side portions at least partially contoured-shaped on its upper edge to allow for the upper portion of the cover to conform to a contoured upper surface shape of the pad.

42. The cover according to claim 36, wherein the upper portion of the cover further comprises:

means for providing heat through the impermeable top layer.

43. The cover according to claim 42, wherein the means for providing heat through the impermeable top layer is a heating pad layer in a face-to-face underlying relationship to at least a portion of the underlying layer of the upper portion.

44. The cover according to claim 42, wherein the means for providing heat through the impermeable top layer comprises heating means integrally incorporated in at least a portion of the underlying layer of the upper portion.

* * * * *